United States Patent [19]

Deconnick

[11] Patent Number: 5,029,616

[45] Date of Patent: Jul. 9, 1991

[54] CONTROLLING WARP TENSION AS A FUNCTION OF WEAVING PATTERN

[75] Inventor: Filip Deconnick, Keiberg, Belgium

[73] Assignee: Picanol N.V., Belgium

[21] Appl. No.: 470,592

[22] Filed: Jan. 26, 1990

[30] Foreign Application Priority Data

Feb. 6, 1989 [BE] Belgium ..... 8900115

[51] Int. Cl.[5] ..... D03D 49/04; D03D 49/10

[52] U.S. Cl. ..... 139/110; 139/25

[58] Field of Search ..... 139/109, 110, 25, 105, 139/1 R, 103, 319, 99, 311

[56] References Cited

U.S. PATENT DOCUMENTS

| | | | |
|---|---|---|---|
| 3,952,779 | 4/1976 | Kodis | 139/110 |
| 4,554,951 | 11/1985 | Hirano et al. | 139/110 X |
| 4,582,095 | 4/1986 | Kronholm | 139/1 R |
| 4,721,134 | 1/1988 | Dorman et al. | 139/25 |
| 4,750,527 | 9/1988 | Rehling | 139/110 |
| 4,817,677 | 4/1989 | Deconnick et al. | 139/99 |
| 4,827,985 | 5/1989 | Sugita et al. | 139/110 X |

FOREIGN PATENT DOCUMENTS

| | | |
|---|---|---|
| 3609845A1 | 9/1987 | Fed. Rep. of Germany . |
| 2155852 | 5/1973 | France . |
| WO88/05089 | 7/1988 | World Int. Prop. O. . |

*Primary Examiner*—Andrew M. Falik

*Attorney, Agent, or Firm*—Bacon & Thomas

[57] ABSTRACT

A method of weaving cloth having a weaving pattern which varies according to which warp threads are supplied and according to which weft threads are bound into the warp threads, includes the steps of forming successive different pattern areas and regulating the warp tension according to a reference value during weaving such that its variation is a function of the different pattern areas to be formed. Control of the reference value is accomplished by determining a reference value for the warp tension as a function of the weaving pattern, and regulating the warp tension by measuring the actual warp tension, comparing the measured warp tension with the reference value, and controlling the motor of the let-off such that the difference between the reference value and the measured warp tension is regulated to zero. A weaving machine is arranged to carry out each of the above method steps.

18 Claims, 3 Drawing Sheets

CONTROLLING WARP TENSION AS A FUNCTION OF WEAVING PATTERN

BACKGROUND OF THE INVENTION

This invention concerns a method for weaving cloths with a weaving pattern, and weaving machines designed to use this method. More specifically, by weaving pattern is meant all weaving patterns which can be carried out in a cloth, such as the weft pattern, the binding pattern and the cloth take-up pattern or a combination of these patterns, which as is known can be created respectively by working with different weft threads, by using different bindings and by using different cloth take-up speeds.

Weaving patterns in which different pattern areas are formed successively are well known. The fact that different pattern areas are formed successively has the disadvantage that, at least with the ordinary working methods, the appearance of the cloth is not optimum for all pattern areas. Especially in the transitions between the various pattern areas, i.e. whenever there is a change in the cloth take-up pattern and/or the weft pattern and/or the binding pattern, faults can appear in the cloth, such as marks in the cloth.

SUMMARY OF THE INVENTION

The present invention has as its aim a method for weaving cloths with any of the above-mentioned weaving patterns which offers a solution to the above-mentioned disadvantages, so that a cloth of that sort can be woven flawlessly, and as a result with a cloth appearance of extremely good quality.

For this purpose, the present invention concerns a method for weaving cloths with a weaving pattern, according to which warp threads are supplied and weft threads are bound into them, so that according to the preset weaving pattern, different pattern areas can be formed successively, characterized in that the warp tension is regulated during weaving according to a reference value and that this reference value is controlled in such a manner during weaving that its variation is a function of the different pattern areas to be formed according to the weaving pattern. In other words, this means that the variations in the warp tension pattern are carried out simultaneously or practically simultaneously with the transitions in the cloth or with the variations in the weaving pattern. It is obvious that according to this method the most suitable warp tension for the pattern area being woven can always be selected. The desired optimum warp tension as a function of the weaving pattern to be woven can be determined in advance by experience or on the basis of tables, etc.

The present invention also concerns a weaving machine which uses the above-mentioned method. In this weaving machine, the selected, and thus known weaving pattern is used to set the reference values for the warp tension, whereby regulating the actual warp tension is preferably done by controlling the warp let-off motor of the warp let-off. In order to achieve this, the actual warp tension is measured and the warp let-off motor is controlled in such a way, by means of a feedback mechanism, that the difference between the measured value and the reference value is regulated to nil.

In order to better explain the characteristics of the invention, the following embodiments are described by way of example, without being limitative in any way, with reference to the drawings, where:

DETAILED DESCRIPTION OF THE PREFERRED EMBODIMENTS

Figure 1:
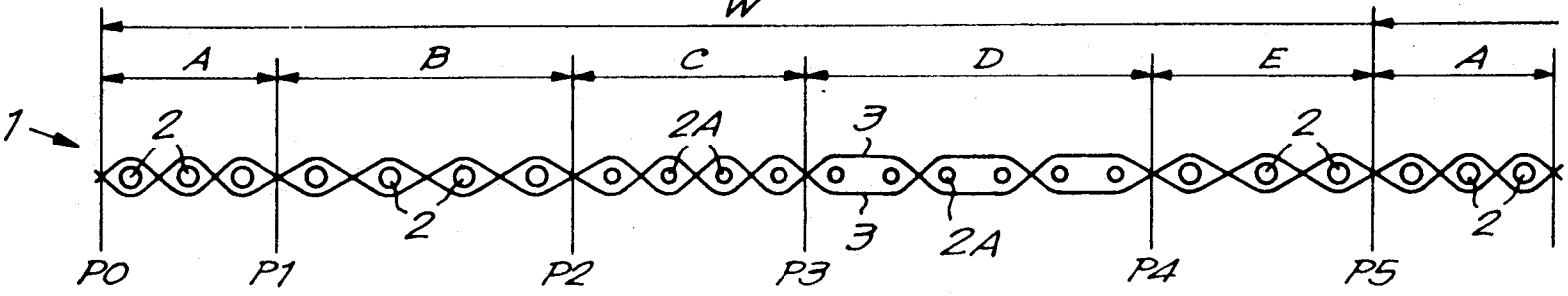
FIG. 1 shows a section of a cloth in which a number of variations which may appear in a weaving pattern are represented.

FIG. 1 shows a cloth 1 with a weaving pattern. As is known, such a weaving pattern extends over a certain cloth length W and is made up of different pattern areas A, B, C, D and E, whereby the cloth 1 is uniform within this pattern area. The transitions between the successive pattern areas are indicated by references P0 to P5.

At point P1, there is a change in the cloth take-up pattern, more specifically due to an increased speed of the cloth take-up, as a result of which the weft threads 2 are farther away from each other.

At point P2, there is a change in the weft pattern, which in the given example has been caused by a switch to a different sort of weft threads 2A which are thinner.

At point P3, there is a change in the binding pattern, i.e. the weft threads 2A are e.g. woven into the warp threads 3 in a different way in pattern area D than in pattern area C.

At point P4, there is a change in both the weft and the binding.

Finally, at point P5 there is again a change in the weaving pattern because of a change in the cloth take-up pattern, due to for example a lowering of the speed of the cloth take-up. At that point, P5, a new similar cloth length W begins.

In order to obtain an optimum cloth appearance and to prevent the formation of cloth marks near the points P1 to P5, the warp tension is regulated in accordance with a reference value R according to the invention, which is described hereafter and which, in its turn, is controlled during weaving as a function of the character of the pattern areas A to E to be woven and the character of the transitions P0 to P5 between the successive pattern areas. It is clear that all sorts of changes in the weaving pattern can be taken into account, i.e. changes which result either from the binding or shedding pattern, the weft pattern, the cloth take-up pattern or a combination of two or more of said types of patterns.

Figure 2:
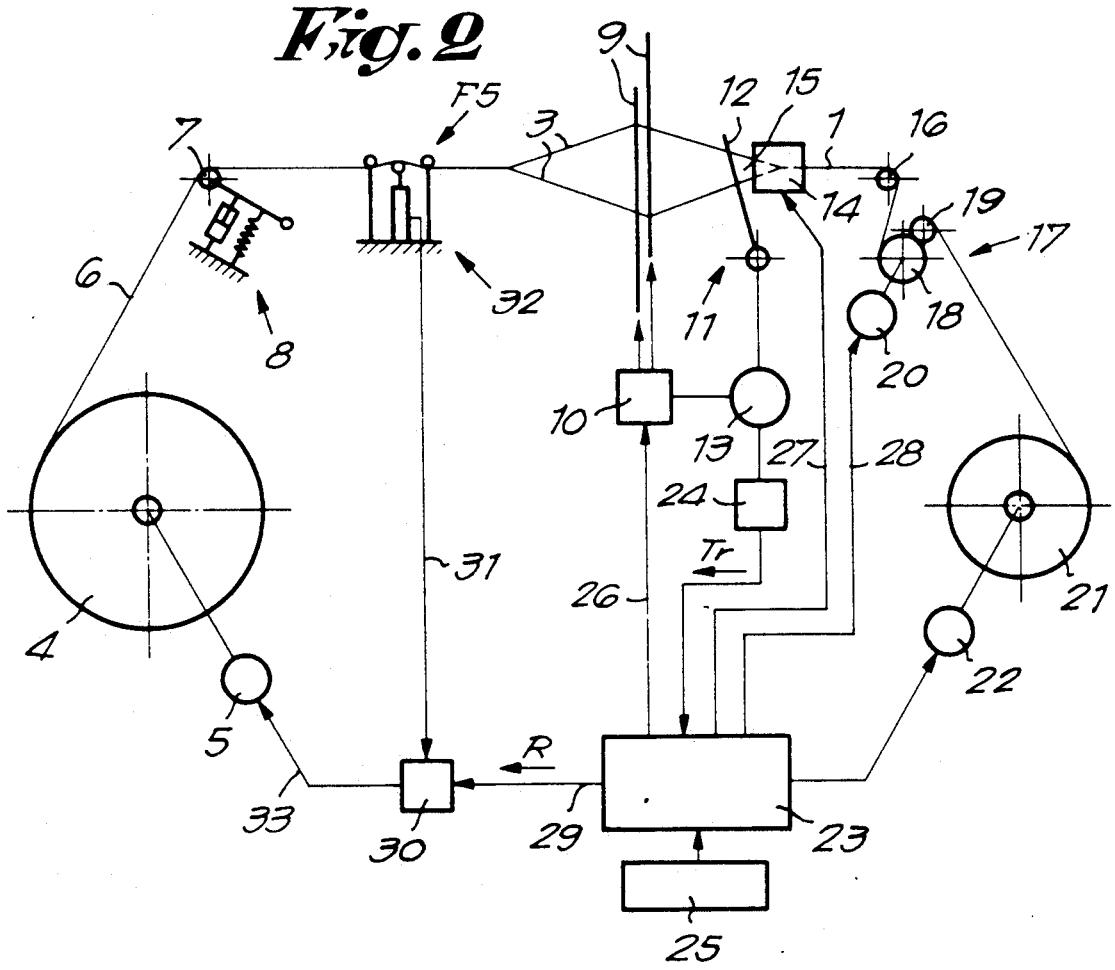
FIG. 2 shows a schematic illustration of a weaving machine according to the invention.

FIG. 2 shows a schematic illustration of a weaving machine which is specially designed for weaving according to the method of the present invention. The conventional parts of a weaving machine are, as is known: the warp beam 4; the warp let-off motor 5; the warp 6; the backrest roller 7, provided with a spring-damping device 8; the harnesses 9; the harness motion, which consists for example of a dobby 10 which moves the harnesses 9 up and down according to the preset binding pattern; the sley 11 with the reed 12; the main drive motor 13; the insertion means 14 which make it possible to insert the weft threads 2–2A into the shed 15 according to the selected preset weft pattern; the breast beam 16; the cloth take-up motion 17 consisting of the sand beam 18, the counter roller 19 and the controllable motor 20 for the sand beam, which can make the speed of the cloth take-up vary according to the selected preset cloth take-up pattern; the cloth beam 21 and the motor 22 to drive the cloth beam 21. The general control unit 23 which controls said parts of the weaving machine is also indicated, as well as the conventional pulse generator 24 which emits a certain number of pulses, ten for example, per rotation of the main drive shaft, i.e. per weft insertion.

It is clear that in the case of an airjet weaving machine, by said insertion means 14 are meant the color selector and the main nozzles. In the case of a rapier weaving machine, by insertion means 14 are meant the thread presentation mechanism and the rapiers which introduce weft threads 2–2A into the shed 15.

The weaving pattern to be woven can be entered by means of an input device 25, for example on a data storage medium or by reading it into a memory. According to the data read in, the control unit 23 controls the parts of the weaving machine which determine the weaving pattern, i.e. in the example given above the dobby 10, the insertion means 14 and the motor 20 in the desired order, by means of control signals 26, 27 and 28 respectively. According to the present invention, a control unit 23 is used which also emits a signal 29 according to the weaving pattern read in, representing a reference value R which gives the optimum desired warp tension for that current weaving pattern. This signal 29 is transmitted to a control element 30, which also receives a signal 31 from a warp tension gauge 32, representing the current warp tension. The control element 30 emits a control signal 33 and controls the motor 5 of the warp let-off such that the tension in the warp 6 takes the value demanded by the signal 29. In order to achieve this the warp tension is continually measured by means of said warp tension gauge 32, such that the measured tension, according to signal 31, tends towards the current reference value R. This also means that the control signal 33 is always in accordance with, and preferably in proportion to, the difference between the signal 29 and the signal 31. The motor 5 of the warp let-off is controlled in a way that its speed is in proportion to said difference.

Figure 3:
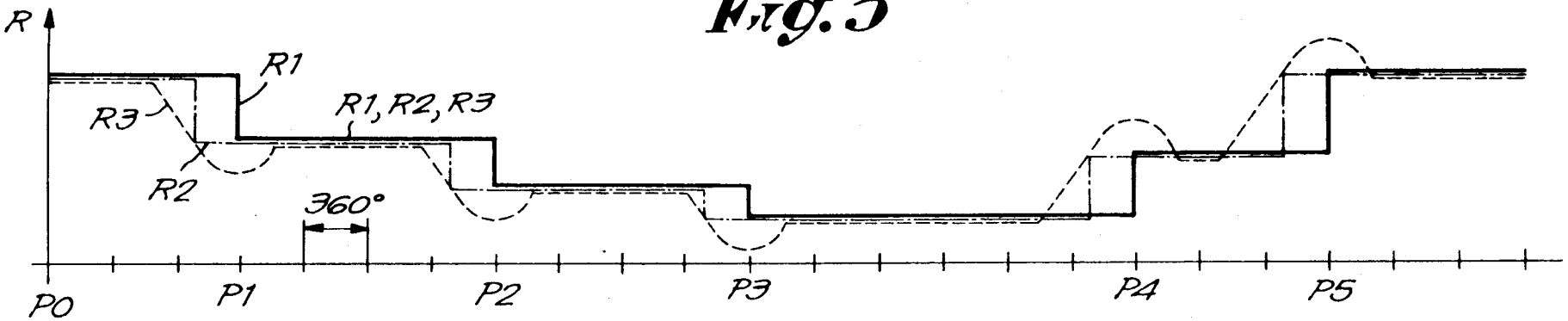
FIG. 3 shows an example of a setting of the warp tension according to the invention, in particular for the cloth in FIG. 1.

FIG. 3 shows the possible variation of said reference value R for the cloth in FIG. 1 according to the number of crank angle degrees X of the main shaft of the weaving machine. It is clear that for each change at point P1 to P5 in the weaving pattern, another reference value R for the warp tension will normally have to be set in order to obtain an optimum cloth appearance.

The curve R1 in FIG. 3 shows a rather theoretical variation of the selected reference value. The reference value R1 is varied at the moments corresponding to P1 to P5. Because of the inertia of the regulation system, which consists of a control element 30 which, as mentioned before, emits a control signal 33 according to the difference between the signal 29 and the signal 31, it is advisable, however, for the reference value R, i.e. the signal 29, to be controlled in advance, as shown by the curve R2; this has the advantage that the changes in the actual warp tension virtually occur at the right moment, i.e. when the transitions P1 to P5 occur in the cloth. In order to counter the inertia of said system, it is also possible to build in a brief amplitude overshoot in the variation of the reference value, as shown in curve R3. In this way, the warp tension actually obtained will respond very quickly to the signal 29.

The variations of the curves R1, R2 or R3 as mentioned above can be stored in the memory of the control unit 23. In order to make the variation of the reference value R which is produced by signal 29, and which represents the desired warp tension, synchronous with the control of the weaving machine parts which determine the weaving pattern, use is made of the trigger signal Tr, produced by the pulse generator 24 mounted on the main shaft of the weaving machine. This signal Tr is represented schematically in FIG. 4 as a function of the number of crank angle degrees X of the main shaft. In order to effect the changes in the reference values according to the curves R1, R2 or R3, the number of pulses per cloth length W can be counted, whereby a certain pulse can be used to supply the exact reference value R to the control element 30 at the right moment. If the trigger signal emits ten pulses per rotation of the main shaft, as in FIG. 4, the signal 29 can be corrected every tenth of the weft insertion cycle, according to the selected variation of the reference value R.

Figure 4:
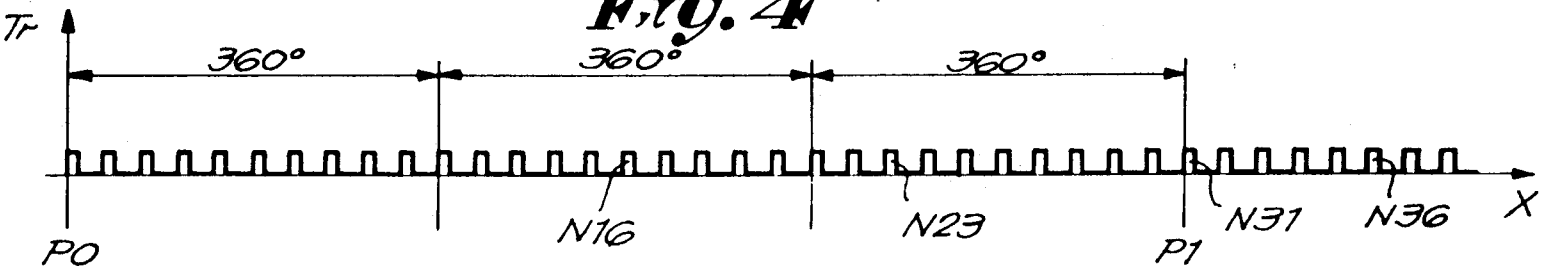
FIG. 4 shows the trigger signal of the weaving machine.

In the example shown in FIGS. 3 and 4, in the case where the curve R1 is used, the thirty-first pulse N31 is the signal for changing the reference value R at the transition P1. In the case where the curve R2 is used, the reference value R is changed at the transition P1 at the twenty-third pulse N23. In the case where the curve R3 is used, the reference value R is changed at the transition P1 according to the given function variation at each pulse from the sixteenth pulse N16 up to the thirty-sixth pulse N36. A similar reasoning applies to the transitions P2 to P5.

It is obvious that according to the present invention it is not necessary to enter the variation of the reference value R in the control unit 23, but the data for controlling the weaving machine parts 10, 14 and 20 which determine the weaving pattern should however be entered. For this purpose, the control unit 23 can be equipped with interpretation means, for example an appropriate program, which make it possible to automatically determine the most favourable variation of the reference value R on the basis of the data entered for controlling said weaving machine parts.

It is also obvious that the variation of the reference value R (R1, R2, R3) between the successive transitions P0 to P5 does not necessarily have to be horizontal.

Figure 5:
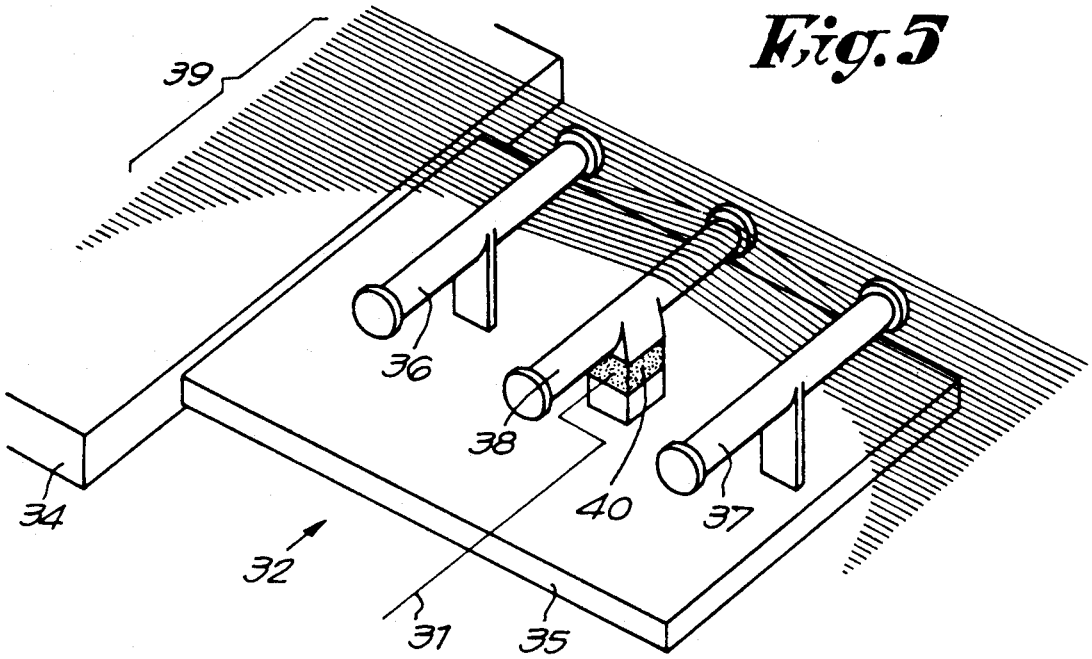
FIG. 5 shows a view of a warp tension gauge, more specifically in the direction of the arrow F5 in FIG. 2.

An important characteristic of the present invention is that to measure the actual warp tension, a very sensitive measuring device is used in order to limit time delays. Therefore, warp tension gauge 32 should preferably be of the type represented in FIG. 5. This warp tension gauge 32 includes three thread guides 36, 37 and 38, mounted on a support 35 attached to the frame 34 of the weaving machine, and which operate on only a part 39 of the warp 6. The warp threads of this part 39 pass under the thread guides 36 and 37 and over the thread guide 38, such that the pressure exerted on the thread guide 38 represents the tension in the warp 6. According to FIG. 5, this pressure is measured by means of a pressure-sensitive element 40, for example a piezoelectric crystal which supports the thread guide 38 and emits a signal 31 which is a function of said pressure.

Figure 6:
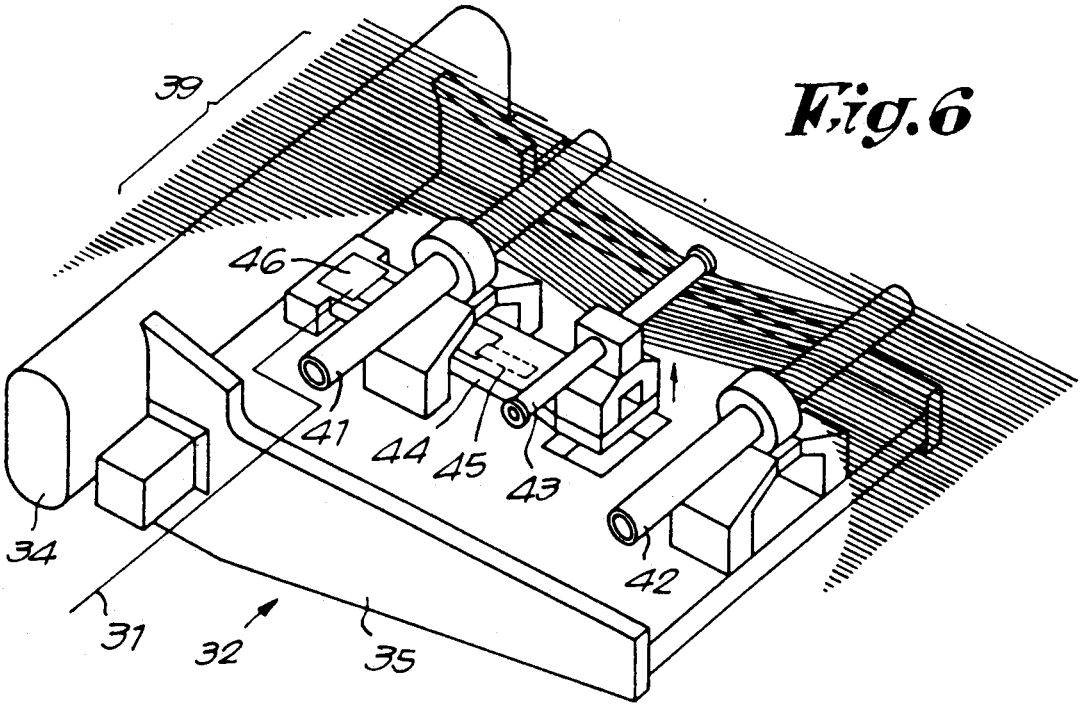
FIG. 6 shows a variant of the warp tension gauge according to FIG. 5.

FIG. 6 shows a variant of the warp tension gauge 32. Three thread guides 41, 42 and 43 are also used here. The warp threads of the part 39 pass over the outer thread guides 41 and 42, and under the thread guide 43 positioned between the two latter, such that an upward force is exerted on them. The middle thread guide 43 is mounted on an elastic lever 44 whose inflection is measured by means of a strain gauge 45 which provides a signal 31 proportional to the tension in the warp 6 by means of a measuring device 46.

It is obvious that said signal 31 can represent either the instantaneous warp tension or the average warp tension over a certain period of time.

The present invention is not restricted to the embodiments described by way of example and shown in the accompanying drawings; on the contrary, such a method for weaving cloths with one of said weaving patterns and the weaving machines which use these methods can be made in several sorts of variants while still remaining within the scope of the invention.

I claim:

1. A method for weaving cloth having a preset weaving pattern, wherein warp threads are supplied and weft threads are bound into the warp threads to form successive different pattern areas according to the preset weaving pattern, comprising the steps of regulating warp tension according to a reference value during weaving, and controlling the reference value during weaving such that the reference value varies as a function of the different pattern areas to be formed according to the preset weaving pattern, wherein the step of controlling the reference value is performed as a function of a pattern area to be formed before the pattern area to be formed is actually formed.

2. A method for weaving cloth having a preset weaving pattern, wherein warp threads are supplied and weft threads are bound into the warp threads to form successive different pattern areas according to the present weaving pattern, comprising the steps of regulating warp tension according to a reference value during weaving, and controlling the reference value during weaving such that the reference value varies as a function of the different pattern areas to be formed according to the preset weaving pattern, wherein the step of controlling the reference value is executed with a short amplitude overshoot at transitions between two successive pattern areas.

3. A method for weaving cloth having a preset weaving pattern, wherein warp threads are supplied and weft threads are bound into the warp threads to form successive different pattern areas according to the present weaving pattern, comprising the steps of regulating warp tension according to a reference value during weaving, and controlling the reference value during weaving such that the reference value varies as a function of the different pattern areas to be formed according to the preset weaving pattern, wherein the step of controlling the reference value is performed as a function of a shedding pattern.

4. A method for weaving cloth having a preset weaving pattern, wherein warp threads are supplied and weft threads are bound into the warp threads to form successive different pattern areas according to the preset weaving pattern, comprising the steps of regulating warp tension according to a reference value during weaving, and controlling the reference value during weaving such that the reference value varies as a function of the different pattern areas to be formed according to the preset weaving pattern, wherein the step of controlling the reference value is performed as a function of a weft pattern.

5. A method for weaving cloth having a preset weaving pattern, wherein warp threads are supplied and weft threads are bound into the warp threads to form successive different pattern areas according to the preset weaving pattern, comprising the steps of regulating warp tension according to the a reference value during weaving, and controlling the reference value during weaving such that the reference value varies as a function of the different pattern areas to be formed according to the preset weaving pattern, wherein the step of controlling the reference value is performed as a function of a cloth take-up pattern.

6. A method as claimed in claim 1, 2, 3, 4, or 5, wherein the step of regulating the warp tension includes the step of controlling the motor of a warp let-off.

7. A method as claimed in claim 1, 2, 3, 4, or 5, wherein the step of regulating warp tension according to the reference value comprises the steps of measuring the warp tension, comparing the measured warp tension with the reference value, and controlling the motor of the let-off such that the difference between the reference value and the measured warp tension is regulated to zero.

8. A method as claimed in claim 7, wherein the step of measuring the warp tension is carried out by means of a warp tension gauge.

9. A method as claimed in claim 7, wherein the step of measuring the warp tension is carried out over only a part of the warp.

10. A weaving machine, comprising means for supplying warp threads and means for binding weft threads into the warp threads to form successive different pattern areas according to a preset weaving pattern, comprising regulating means for regulating warp tension according to a reference value during weaving, and control means for controlling the reference value during weaving such that the reference value varies as a function of the different pattern areas to be formed according to the preset weaving pattern, said control means comprising means for controlling the reference value as a function of a pattern area to be formed before the pattern area to be formed is actually formed.

11. A weaving machine, comprising means for supplying warp threads and means for binding weft threads into the warp threads to form successive different pattern areas according to a preset weaving pattern, comprising regulating means for regulating warp tension according to a reference value during weaving, and control means for controlling the reference value during weaving such that the reference value varies as a function of the different pattern areas to be formed according to the preset weaving pattern, said control means comprising means for executing control of the reference value with a short amplitude overshoot at transitions between two successive pattern areas.

12. A weaving machine, comprising means for supplying warp threads and means for binding weft threads into the warp threads to form successive different pattern areas according to a preset weaving pattern, comprising regulating means for regulating warp tension according to a reference value during weaving, and control means for controlling the reference value during weaving such that the reference value varies as a function of the different pattern areas to be formed according to the preset weaving pattern, said control means further comprising means for controlling the reference value as a function of a shedding pattern.

13. A weaving machine, comprising means for supplying warp threads and means for binding weft threads into the warp threads to form successive different pattern areas according to a preset weaving pattern, comprising regulating means for regulating warp tension according to a reference value during weaving, and control means for controlling the reference value during weaving such that the reference value varies as a function of the different pattern areas to be formed according to the preset weaving pattern, said control means comprising means for controlling the reference value as a function of a weft pattern.

14. A weaving machine, comprising means for supplying warp threads and means for binding weft threads into the warp threads to form successive different pattern areas according to a preset weaving pattern, comprising regulating means for regulating warp tension according to a reference value during weaving, and control means for controlling the reference value during weaving such that the reference value varies as a function of the different patterns areas to be formed according to the preset weaving pattern, said control means comprising means for controlling the reference value as a function of a cloth take-up pattern.

15. A weaving machine as claimed in claim 10, 11, 12, 13, or 14, wherein said regulating means comprises means for controlling the motor of a let-off.

16. A weaving machine as claimed in claim 10, 11, 12, 13, or 14, wherein said regulating means further comprises means for measuring the warp tension, means for comparing the measured warp tension with the reference value, and means for controlling the motor of the warp let-off such that the difference between the reference value and the measured warp tension is regulated to zero.

17. A weaving machine as claimed in claim 16, wherein said measuring means comprises a warp tension gauge.

18. A weaving machines as claimed in claim 16, wherein said measuring means comprises means for measuring the warp tension over only part of the warp.

* * * * *

UNITED STATES PATENT AND TRADEMARK OFFICE

CERTIFICATE OF CORRECTION

PATENT NO. : 5,029,616

DATED : July 9, 1991

INVENTOR(S) : FILIP DECONINCK

It is certified that error appears in the above-identified patent and that said Letters Patent is hereby corrected as shown below:

On Title Page: Item [19] & [75] the Inventor's name should be corrected to read —FILIP DECONINCK— not "FILIP DECONNICK".

Signed and Sealed this

Thirteenth Day of October, 1992

*Attest:*

*Attesting Officer*

DOUGLAS B. COMER

*Acting Commissioner of Patents and Trademarks*